US008186789B2

(12) United States Patent
Aono et al.

(10) Patent No.: US 8,186,789 B2
(45) Date of Patent: May 29, 2012

(54) INKJET PRINTING APPARATUS AND INK EJECTION CONTROL METHOD

(75) Inventors: Kiyomi Aono, Kawasaki (JP); Osamu Iwasaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 495 days.

(21) Appl. No.: 12/361,159

(22) Filed: Jan. 28, 2009

(65) Prior Publication Data

US 2009/0195577 A1 Aug. 6, 2009

(30) Foreign Application Priority Data

Feb. 4, 2008 (JP) ..... 2008-024157

(51) Int. Cl.
*B41J 29/38* (2006.01)

(52) U.S. Cl. ..... 347/9; 347/10; 347/11

(58) Field of Classification Search ..... 347/9–12, 347/14

See application file for complete search history.

(56) References Cited

U.S. PATENT DOCUMENTS

| | | | | |
|---|---|---|---|---|
| 5,745,132 | A | 4/1998 | Hirabayashi et al. | |
| 6,019,448 | A | 2/2000 | Yano et al. | |
| 6,142,600 | A | 11/2000 | Takahashi et al. | |
| 6,257,691 | B1 | 7/2001 | Iwasaki et al. | |
| 6,260,938 | B1 | 7/2001 | Ohtsuka et al. | |
| 6,310,636 | B1 | 10/2001 | Tajika et al. | |
| 6,312,096 | B1 | 11/2001 | Koitabashi et al. | |
| 6,331,039 | B1 | 12/2001 | Iwasaki et al. | |
| 6,543,869 | B2 * | 4/2003 | Irizawa et al. | 347/14 |
| 6,601,938 | B1 | 8/2003 | Iwasaki et al. | |

FOREIGN PATENT DOCUMENTS

| | | | |
|---|---|---|---|
| JP | 4-105957 A | | 4/1992 |
| JP | 04105957 A | * | 4/1992 |
| JP | 5-31905 | | 2/1993 |

* cited by examiner

*Primary Examiner* — Jason Uhlenhake

(74) *Attorney, Agent, or Firm* — Fitzpatrick, Cella, Harper & Scinto

(57) ABSTRACT

For a temperature adjustment process that uses high viscosity ink and is based on a first table, in a low temperature environment, an ink refill failure may occur and lower density may appear in high duty printing. Also for a temperature adjustment process that uses high viscosity ink and is based on second and third tables, in a low temperature environment, an ink refill failure may occur and lower density may appear. On the other hand, for a temperature adjustment process that employs a fourth table, a smaller pre-heat pulse width than that for the first table, for the conventional temperature adjustment, is employed in the same low temperature environment. Therefore, an ink refill failure does not occur, and horizontal or vertical gaps do not appear during high duty printing.

6 Claims, 15 Drawing Sheets

Po = CONSTANT, Ra(ηa) > Rb(ηb)
WHERE Ta < Tb

| | REFILL FREQUENCY (KHz) AT 25°C (PRE-HEAT: 0.542 μsec) | CONVENTIONAL PREHEATING AT 15°C | |
|---|---|---|---|
| | | REFILL FREQUENCY (KHz) (PRE-HEAT: 0.597 μsec) | HIGH-DUTY PRINTING |
| NORMAL INK | 15 | 12.8 | ○ |
| HIGH VISCOSITY INK | 15 | 11.7 | × |

FIG.9

| | PRE-HEAT PULSE P1 ($\mu$sec) |
|---|---|
| FIRST TEMPERATURE OR LOWER | 0.375 |
| ABOVE FIRST TEMPERATURE | 0.542 |

FIG.10

| TABLE No. | | 1 | 2 | 3 | 4 |
|---|---|---|---|---|---|
| NORMAL INK | PRE-HEAT ($\mu$sec) | 0.597 | 0.542 | 0.438 | 0.375 |
| | HIGH-DUTY PRINTING | ○ | ○ | ○ | ○ |
| HIGH VISCOSITY INK | PRE-HEAT ($\mu$sec) | 0.597 | 0.542 | 0.438 | 0.375 |
| | HIGH-DUTY PRINTING | × | × | × | ○ |

FIG.11

| | PULSE WIDTH (μsec) | | | EJECTION CHARACTERISTIC | |
|---|---|---|---|---|---|
| | PRE-HEAT | INTERVAL | MAIN HEAT P3 | REFILL FREQUENCY (KHz) | EJECTION VOLUME (ng) |
| FIRST TEMPERATURE OR LOWER (19°C OR LOWER) | 0.375 | 1.823 | 1.052 | 12.6 | 23.6 |
| ABOVE FIRST TEMPERATURE (19.5°C OR HIGHER) | 0.542 | 0.948 | 1.76 | 15 | 26 |

FIG.13

| ENVIRONMENT TEMPERATURE | LESS THAN 10°C | 10°C OR HIGHER TO LESS THAN 15°C | 15°C OR HIGHER TO 19°C OR LOWER |
|---|---|---|---|
| TABLE NO. | 4 | 4 | 4 |
| PRE-HEAT | 0.375 | 0.375 | 0.375 |
| REFILL FREQUENCY | 11.2 | 12.0 | 12.6 |

FIG.14

| ENVIRONMENT TEMPERATURE | LESS THAN 10°C | 10°C OR HIGHER TO LESS THAN 15°C | 15°C OR HIGHER TO 19°C OR LOWER |
|---|---|---|---|
| TABLE NO. | 6 | 5 | 4 |
| PRE-HEAT | 0.219 | 0.323 | 0.375 |
| REFILL FREQUENCY | 12.0 | 12.5 | 12.6 |

FIG.15

INKJET PRINTING APPARATUS AND INK EJECTION CONTROL METHOD

BACKGROUND OF THE INVENTION

1. Field of the Invention

The present invention relates to an inkjet printing apparatus and an ink ejection control method. Particularly, the present invention relates to controlling of pulses used in an ink ejection system in which the pulses are applied to an electro-thermal transducer element to heat ink and to cause a bubble for ejecting ink.

2. Description of the Related Art

Inkjet printing apparatuses are so-called non-impact type printing apparatuses that perform the high speed, reduced-noise printing for various types of print media. Because of the evident advantages afforded by such inkjet printing apparatuses, they are widely employed as printing mechanisms in printers, copiers, facsimile machines and large format printers for industrial use (the printing of posters, CAD graphics, etc.).

Conventionally, dye ink has been employed for inkjet printing apparatuses; however, printed matter with dye ink is generally inferior in lightfastness, gas resistance and water resistance, and is not appropriate for outdoor posted notifications or for records to be kept for a long period.

On the other hand, a pigment ink employing a pigment as a coloring agent is superior to dye ink in lightfastness, gas resistance and water resistance. However, the pigment used is not dissolved in a solvent, but is dispersed in a solvent. Therefore, because the viscosity of a solvent used as a dispersing agent is high, the viscosity of pigment ink tends to be higher than that of dye ink. Furthermore, especially for some types of business-use printing apparatuses that provide superior ink fixing properties and color development while performing fast, high-quality printing, a surface preparation process is performed for paper to react with ink. In this case, a solvent that reacts with a paper surface preparation fluid may be added to ink, and accordingly, the viscosity of the ink tends to become higher than that of normal pigment ink. Furthermore, in a low temperature environment the viscosity of such high-viscosity ink is sharply increased, and as a result, a problem may arise in that the amount of ink ejected could be reduced or deterioration of the ink refill performance could occur.

As a measure to this problem, there is a well known conventional inkjet printer or the like that adjusts the temperature of ink (hereinafter also referred to simply as temperature adjustment) to control ink viscosity that exercises an affect on the volume of ink ejected.

For instance, an example inkjet printer of this type performs temperature adjustments by employing a heater (either a heater used only for heating a print head, or a heater also used for an ink ejection) for heating the print head where ink is held, and a temperature sensor for detecting the temperature of the print head associated with the ink. Specifically, the temperature adjustment is performed by feeding back the temperature detected by the temperature sensor to an application of heat by the heater. Also, there is known one in which detected temperature feedback is not employed, and instead, heat generation using a heater is simply controlled to perform the temperature adjustment. One arrangement for this unit provides for the heater and a temperature sensor to be mounted near the print head, e. g., to be mounted on the member constituting the print head, whereas another arrangement provides for the heater and the temperature sensor to be mounted separately from the print head.

Furthermore, a system has been known that directly changes the amount of ink to be ejected, without performing a temperature adjustment. This system may be employed separately, or with one of the above described methods. Specifically, according to this system, upon the application of a pulse to an electro-thermal conversion element (hereinafter also referred to as an ejection heater), thermal energy is generated by the ejection heater to heat ink and form a bubble, and the pressure built up by the bubble is employed to eject ink. In this system, a pulse width of the pulse (hereinafter also referred to as a heat pulse) to be applied to the ejection heater is changed to control the quantity of heat generated for changing the volume of the ejected ink.

The following performance manners of the temperature adjustments, which are made by employing and combining the above described arrangements, are known.

(1) Constantly performing temperature adjustments for a print head (outside/vicinity). Temperature feedback included.

(2) Performing temperature adjustments for a print head only as needed (outside/vicinity). Temperature feedback included.

(3) Performing temperature adjustments for making a print head at a high temperature (higher than that of an environment). Temperature feedback included.

(4) Modulating the pulse width of a single heat pulse (single pulse).

(5) Modulating the pulse width of divided heat pulses (double pulse).

However, in the performance manner (1), since temperature adjustments are constantly performed, the evaporation of a solvent water in ink, which is accompanied by heating by a heater, is accelerated and thus induce increasing viscosity of ink inside an ejection opening of a print head, or even adhesion of ink to the ejection opening. As a result, an ejection malfunction, such as a deflection of ink in which an ink ejection direction is deviated and an ink ejection failure, may occur, or relative increase in the concentration of a coloring agent in ink may occur to cause a density change or uneven density in a printed result. In any event, quality deterioration of a printed image would occur.

In the performance manner (2), temperature adjustments are performed only as needed, i.e., this is an improved version of the performance manner (1). According to this performance manner (2), a temperature adjustment is initiated, for example, only after a printing instruction has been entered. Therefore, energy for heating (e.g., the heating quantity ((W) for the heater) must be supplied to reach a predetermined temperature within a comparatively short period of time. But in the event the width of a temperature ripple is increased in a temperature control, a situation may be encountered wherein the accurate temperature control is not possible. In such a case, the amount of ink ejected may fluctuate, due to the ripple, and a density change, or unevenly densities, may occur. On the other hand, to accurately perform a temperature adjustment, the energy to be provided must be reduced. Accordingly, an extended period will be required to reach the target temperature, and thus a problem arises, such that there is an increase in the waiting period for the printing start.

The performance manner (3) is relative for a system wherein a temperature to be adjusted is set that is higher than that for the surrounding environment, in order to counter an effect produced either by a local, external temperature change, or by one that occurs as a result of an increase in the temperature of a print head (a temperature increase occurring during printing). According to performance manner (3), during low-duty printing, fluctuations in the ejected ink volume can be reduced. However, during high-duty printing, e.g., during so-called solid-paint printing, an effect produced by a temperature rise cannot be avoided. In addition, a satisfactory temperature adjustment response for a temperature rise can be obtained when a heater or a temperature sensor is mounted on a substrate, such as one made of alumina, that supports a heater board whereon an ejection heater is arranged. However, the heat capacity of the alumina material used for the substrate is quite large, and thus a temperature ripple could appear that would cause the ejected ink volume to fluctuate.

A system provided in accordance with the performance manner (4), for which the modulation of a pulse width can be accomplished using a single heat pulse (hereinafter also referred to as a single pulse), is employed for a bubble formation, an ink ejection method. Specifically, according to this system, the amount of ink to be ejected can be altered by changing the pulse width of the single pulse. This system, however, can not provide a change, in the amount of ink ejected, that can counter a fluctuation that occurs as a result of a temperature change at a print head. Therefore, a problem, in this case, is that a pulse width modulation system uses the single pulse to control the amount of ink ejected at only a small control width.

A system set up in accordance with the performance manner (5), as described in Japanese Patent Laid-Open No. H05-031905(1993), modulates pulse width using a divided heat pulse and does not have the problems encountered by systems set up in accordance with the above described performance manners. According to an ink ejection control sequence employed for this system, at predetermined periodical intervals, a pre-heat pulse is supplied to heat ink, but only to a temperature whereat the ink is not ejected, and to thereafter supply a main heat pulse that is employed to eject the ink. In this instance, the pulse width of the pre-heat pulse is controlled in order to maintain a constant quantity of ink to be ejected. In a low temperature environment, for example, the pulse width that is set is greater than the pulse width that is used at a normal temperature. Then, when the control sequence is performed at the low temperature, the amount of ink ejected is prevented from being reduced and a stable amount of ink can be ejected.

In addition, the application of the pre-heat pulse is performed to raise the temperature of the ink around the ejection heater, and also to reduce the viscosity of the ink. Furthermore, as a result of the heating performed using the pre-heat pulse, a desired amount of ink can be ejected when the main heat pulse is applied.

However, when the system in accordance with the performance manner (5) is simply performed in case of employing a more viscous ink, such as the above described pigment ink, ink refill function may be deteriorated in a low temperature environment.

Specifically, the rate at which viscosity rises is increased in certain low temperature environments. And in such a case, when the viscosity of ink can not be appropriately reduced by extending the pre-heat pulse width, a fluid velocity of the ink will be lowered. And should this occur, a longer period would be required to fill (or refill) the ink paths inside the ejection openings of the print head and to prepare for the ejection of ink. As a result, the ink refill operation could not be synchronized with the ejection cycle, and this in turn could cause an ink ejection malfunction, such as less ejection amount than that specified for ejection. Especially when high-duty printing is being performed, the degradation of print quality, due to refill failures, becomes overly conspicuous.

Further, even when the pre-heat pulse width is to be extended in order to reduce the viscosity of ink or to maintain an ejection amount, there is a limitation (a required refill time period) on the pre-heat pulse width, as a consequence of an increase in printing speed. Specifically, when there is an increase in printing speed, this is accompanied by a corresponding shortening of the length of the print head drive cycle, and the length of the period for the application of a heat pulse including the pre-heat pulse, must not exceed the length of the cycle.

Moreover, in addition to a demand for increased printing speeds, there is a like demand for a high image quality. That is, a demand exists for improvements in all printing capabilities that would ensure the ejection amounts of ink during printing, even in low temperature environments.

SUMMARY OF THE INVENTION

While taking the above described problems into account, one objective of the present invention is to provide an inkjet printing apparatus and an ink ejection control method that, in consonance with a rise in the viscosity of ink in a low temperature environment, exhibits an appropriate ink refill function.

In a first aspect of the present invention, there is provided an ink jet printing apparatus that uses a print head, which applies an electric pulse to an electro-thermal transducer element to generate a bubble in ink and ejects ink by means of pressure of the bubble, to perform printing, the apparatus comprising: a driving unit for applying the electric pulse having a pre-heat pulse by which no ink is ejected, a main heat pulse for ejecting ink which is applied after the pre-heat pulse is applied, and a pause period between the pre-heat pulse and the main heat pulse, to the electro-thermal transducer element; and a pulse width control unit for when temperature related to a viscosity of ink in the print head is equal to or lower than a predetermined temperature, causing a width of the pre-heat pulse to be smaller than a width of the pre-heat pulse used when the temperature related to a viscosity of ink is higher than the predetermined temperature.

In a second aspect of the present invention, there is provided an ink ejection control method in an ink jet printing apparatus that uses a print head, which applies an electric pulse to an electro-thermal transducer element to generate a bubble in ink and ejects ink by means of pressure of the bubble, to perform printing, the method comprising: a driving step of applying the electric pulse having a pre-heat pulse by which no ink is ejected, a main heat pulse for ejecting ink which is applied after the pre-heat pulse is applied, and a pause period between the pre-heat pulse and the main heat pulse, to the electro-thermal transducer element; and a pulse width control step of when temperature related to a viscosity of ink in the print head is equal to or lower than a predetermined temperature, causing a width of the pre-heat pulse to be smaller than a width of the pre-heat pulse used when the temperature related to a viscosity of ink is higher than the predetermined temperature.

According to the above described arrangement, the amount of ink ejected from the print head at a predetermined temperature or lower, which is related to the viscosity of ink, can be smaller than the amount of ejected ink at a higher than predetermined temperature. Therefore, in consonance with a rise in ink viscosity in a low temperature environment, an appropriate ink refill period can be obtained, and the printing speed can be consistent with the image quality.

Further features of the present invention will become apparent from the following description of exemplary embodiments (with reference to the attached drawings).

BRIEF DESCRIPTION OF THE DRAWINGS

FIG. 9 is a diagram for explaining the refill characteristics obtained when a print head was driven using normal ink and highly viscous ink, and by applying a pre-heat pulse having a width that was determined in accordance with a conventional temperature adjustment;

FIG. 10 is a diagram showing widths for a pre-heat pulse, according to the embodiment of the invention, when an environment temperature is a predetermined first temperature or lower and when it is higher than the first temperature;

FIG. 11 is a diagram showing relations between ink viscosity and ejection states for respective pre-heat pulse widths in the low temperature environment;

FIG. 13 is a diagram showing a pulse width table employed for a predetermined temperature of 19° C. or lower, and a table employed for an environment at a normal temperature higher than 19.5° C.;

FIG. 14 is a diagram showing the pre-heat pulse width and the refill frequency when a predetermined pulse width table was employed for the entire range of the low temperature environment; and FIG. 15 is a diagram showing the pre-heat pulse width and the refill frequency when the pulse width table employed for the entire range of the low temperature environment was changed.

DESCRIPTION OF THE EMBODIMENTS

The preferred embodiments of the present invention will now be described in detail while referring to the accompanying drawings.

First Embodiment

Figure 1:
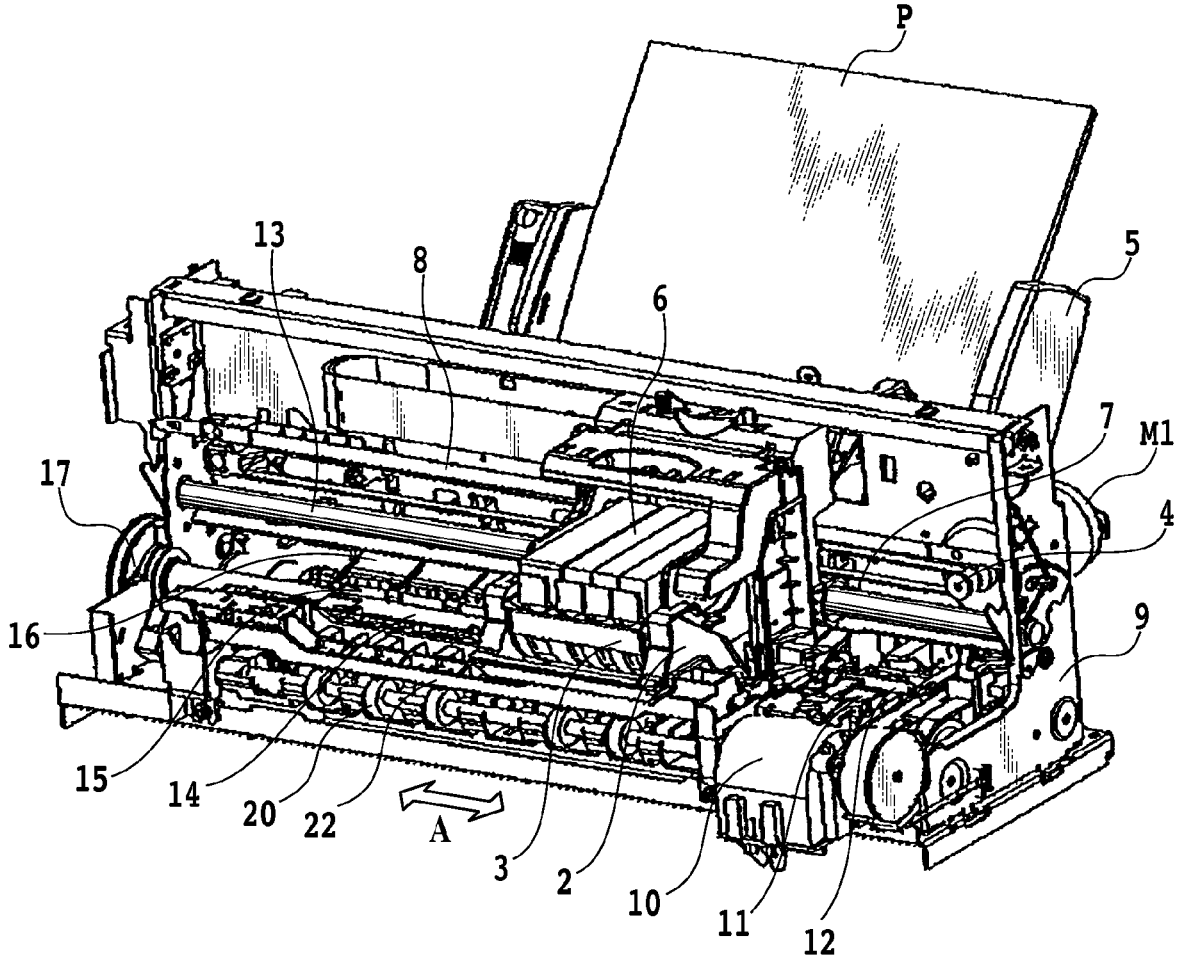
FIG. 1 is a view illustrating the structure of an inkjet printer according to one embodiment of the present invention.

FIG. 1 is a perspective view, except for a case cover, of the structure of an inkjet printer according to a first embodiment of the present invention.

As illustrated in FIG. 1, the inkjet printer of this embodiment includes: a carriage 2, on which a print head 3 is detachably mounted; and a driving mechanism, for moving the carriage 2 to use the print head 3 for scanning. That is, a carriage motor M1 is a drive source that transmits a driving force to the carriage 2, via a transmission mechanism 4 such as a pulley, and reciprocally moves the carriage 2 in the directions indicated by an arrow "A" in FIG. 1. Detachably mounted on the carriage 2 are ink cartridges 6, provided in consonance with the types of ink employed by the inkjet printer. In this embodiment, four colors of ink, i.e., black, cyan, magenta and yellow colors, are employed, and therefore, four ink cartridges are displayed in FIG. 1. In this instance, all the inks employ pigments as coloring agents, and as will be explained later, the ratio of a rise in the viscosity of the ink is large in a low temperature environment, at a predetermined temperature or lower.

Ink supply paths for individual inks are formed in the carriage 2, so that inks from corresponding ink cartridges are supplied to the grooves respectively formed in the black ink chip and the color ink chip. In addition, the carriage 2 and the print head 3, which is made from the above described chips, are adapted to have respective contact faces to establish necessary electrical connections. Therefore, in accordance with a print signal, the print head 3 can apply a voltage pulse to an ejection heater to generate a bubble on the surface of an ink heater, and to thus eject ink through an ejection opening. That is, upon the application of a pulse, the ejection heater, which is an electro-thermal converting element, generates thermal energy. Then, the thermal energy induces film boiling in ink, that forms a bubble, which grows and contracts to cause a pressure change. The thus produced pressure change is used to eject ink through an ejection opening.

In addition, the inkjet printer of this embodiment includes a feeding mechanism (a paper feeding mechanism) 5 for conveying (feeding) a print sheet P, a print medium, a predetermined distance in consonance with scanning performed by the print head 3, as well as a recovery device 10, for performing a recovery process for the print head 3, that is located at one end of the inkjet printer, within the displacement range of the carriage 2 when used for scanning.

With this inkjet printer arrangement, the print sheet P is conveyed, by the feeding mechanism 5, to the area scanned by the print head 3, whereby ink is deposited on the print sheet P to reproduce (print) either images or characters thereon.

The structure of the above inkjet printer will now be described in greater detail. The carriage 2 is connected, at one place, to a drive belt 7, which is one of the components provided for the transmission mechanism 4, which is used to transfer the driving force produced by the carriage motor M1. The carriage 2 is also supported by and can freely slide along a guide shaft 13 in the directions indicated by the arrow A in FIG. 1. With this arrangement, the carriage 2 can be moved forward, or in reverse, by the driving force produced by the forward or reverse rotation of the carriage motor M1. Furthermore, referring again to FIG. 1, a scale 8 is used to detect the location of the carriage 2 in the directions indicated by the arrow A. In this embodiment, to serve as the scale 8, black bars are printed on transparent PET film, at predetermined pitches, and thereafter, one end of the scale 8 is fixed to a chassis 9, while the other is supported by a leaf spring (not shown). Then, when optical detection of the scale bar 8 is performed by a sensor provided for the carriage 2, the position of the carriage 2 can be accurately obtained.

A platen (not shown) is located within an area, opposite the individual ejection opening arrays in the scanning of the print head 3. A print sheet P is conveyed across the platen, with a flat surface for the print sheet P being maintained by the platen, and in this state, ink in individual colors is ejected onto the printing sheet P.

A reference numeral 14 denotes a conveying roller that is driven by a conveying motor M2 (not shown), a reference numeral 15 denotes pinch rollers that make the printing sheet P contact with the conveying roller 14 with springs (not shown), and a reference numeral 16 denotes pinch roller holders 16 that rotatably support the pinch rollers 15. A reference numeral 17 denotes a conveying roller gear that is attached at one end of the conveying roller 14. The rotation of the conveying motor M2 is transmitted to the conveying roller gear 17, via an intermediate gear (not shown), and thus the conveying roller 14 is driven. A reference numeral 20 denotes discharge rollers that are used for discharging the print sheet P on which an image has been formed by the print head 3, out of the printer, and similarly the discharge rollers 20 are driven by the rotation of the conveying motor M2. Furthermore, spurs (not shown) are made to contact with the print sheet by a pressing force exerted by springs (not shown). A reference numeral 22 denotes spur holders that rotatively support the spurs.

As described above, the recovery device 10, for maintaining the ejection function of the print head 3, is arranged within a predetermined range (e.g., a location corresponding to the home position) outside the range (the scanning area) wherein the carriage 2 moves reciprocally during a printing operation). The recovery device 10 includes: a capping mechanism 11, for capping the ejection opening face of the print head 3; and a wiping mechanism 12, for cleaning the ejection opening face (the face wherein the ejection opening arrays for the individual colors are formed) of the print head 3. When the capping mechanism 11 has capped the ejection opening face, a suction mechanism (not shown) provided for the recovery device, such as a suction pump, interlocks with the capped ejection opening face, and forcibly exhausts ink in the ejection openings. As a result, a recovery process, such as the removal of viscous ink or bubbles from the ink flow paths of the print head 3, can be performed. Further, when during an idle period the ejection opening face of the print head 3 is capped, the print head 3 can be protected and the drying of ink can be prevented. In addition, the wiping mechanism 12, which is located near the capping mechanism 11, can perform a cleaning process to remove ink droplets that are attached to the ejection opening face of the print head 3. In this manner, by employing the capping mechanism 11 and the wiping mechanism 12, a normal ejection state can be maintained for the print head.

Figure 2B:
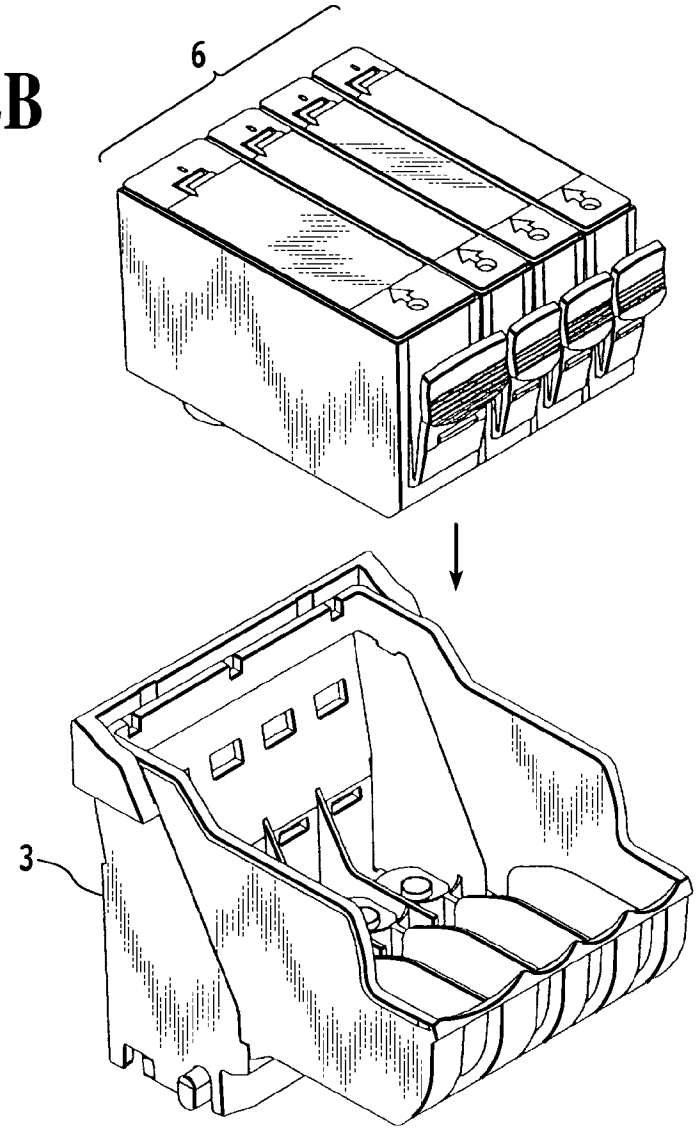
FIGS. 2A and 2B are detailed views illustrating a print head and an ink cartridge in FIG. 1.
Figure 2A:
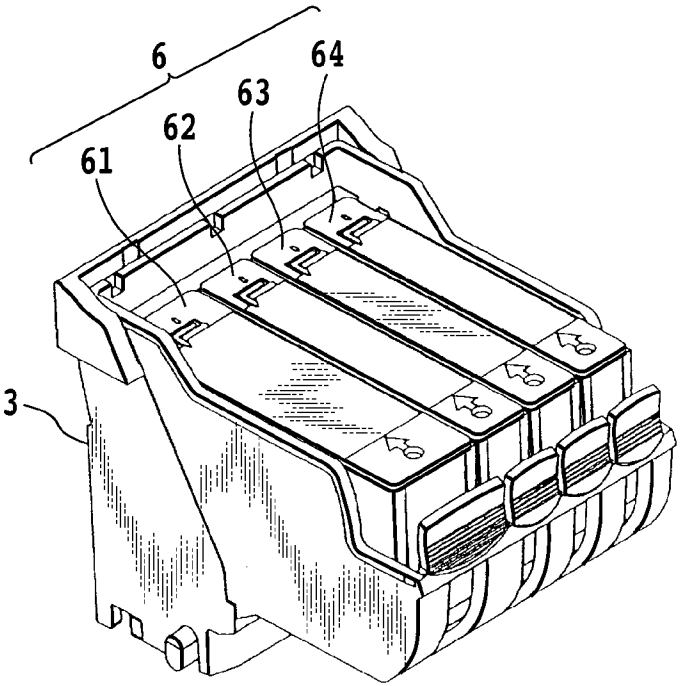

FIGS. 2A and 2B are detailed views illustrating the print head 3 and the ink cartridges 6 in FIG. 1. As shown in FIGS. 2A and 2B, the print head 3 of this embodiment is integrally formed with an ink cartridge holder in which the ink cartridges 6 are to be mounted. That is, ink cartridges 61, 62, 63 and 64 for individual colors are detachably mounted in the ink cartridge holder for the print head 3. For the print head 3, an electrothermal converting element is provided in each ink flow path, at one end of which an ejection opening is formed. By applying an electric pulse to the electrothermal converting element, thermal energy is generated that induces film boiling on the surface of ink. As a result, based on print data, ink that is supplied from the ink cartridges is ejected through the ejection openings. It should be noted that the print head 3, which is integrally formed with the ink cartridge holder, is detachably mounted on the carriage 2 shown in FIG. 1.

Figure 3:
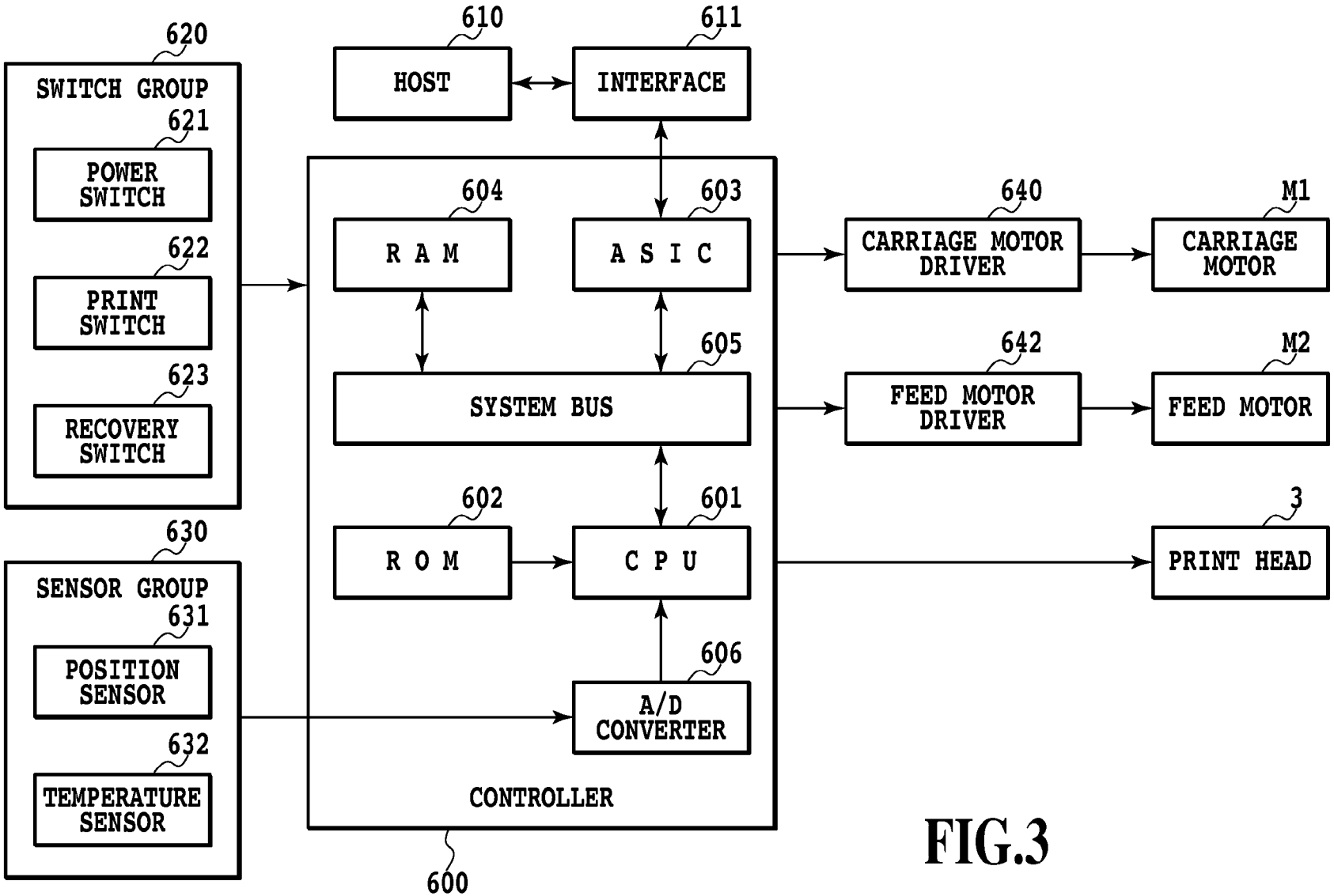
FIG. 3 is a block diagram illustrating the general arrangement of the control system of the inkjet printer that is constituted as shown in FIG. 1.

FIG. 3 is a block diagram illustrating the general control system for an inkjet printer constructed as illustrated in FIG. 1.

As shown in FIG. 3, a controller 600 includes: a CPU 601 for a micro computer mode and a ROM 602, in which are stored a program for performing various printing modes and for controlling corresponding printing operations, a program for controlling the width of a heat pulse, which will be described later, and a required operating table. The controller 600 also includes: an application specific integrated circuit (ASIC) 603, which generates control signals such as those used for controlling a carriage motor M1 when various printing modes are performed, for controlling a paper feed motor M2 and for controlling printing performed by the print head 3. Moreover, the controller 600 includes: a RAM 604, in which an area for developing image data and a work area are prepared; a system bus 605, which serves as an interconnection for the CPU 601 and other elements for the exchange of data. Further, the controller 600 includes an A/D converter 606, which receives analog signals from a sensor group, which will be described later, converts the analog signals into digital signals, and transmits the digital signals to the CPU 601.

A reference numeral 610 denotes a host computer (or an image reader or a digital camera) that serves as an image data supply source, and either transmits image data, commands and status signals to the controller 600, or receives them from the controller 600, via an interface (I/F) 611.

A reference numeral 620 denotes a switch group that consists of switches, such as a power switch 621, a print start switch 622 and a recovery switch 623, for instructing the start of a recovery process for the print head 3, that are employed by an operator when entering instructions. A reference numeral 630 denotes a sensor group that includes: a position sensor 631, which is a photocoupler, used with the scale 8, for detecting whether the print head 3 has been moved and/or is now located at the home position; and a temperature sensor 632, which is located at an appropriate location, relative to a printer, for detecting an environment temperature. Further, a reference numeral 640 denotes driver that drives the carriage motor M1, and a reference numeral 642 denotes a driver that drives the paper feed motor M2. The controller 600 obtains an environment temperature from the temperature sensor 632, and employs the obtained temperature to select a pulse width for pre-heating, which will be described later. An obtaining of the environment temperature may be performed either at the time an inkjet printer is activated or upon the completion of the printing for one page, or the environment temperature may be obtained each time ten pages have been printed or whenever a predetermined period of time has elapsed (e.g., each time printing has been performed for each one hour).

With the above described arrangement, the inkjet printer of this embodiment analyzes a print data command that is transmitted via the interface 611, and develops, in the RAM 602, image data to be printed. In the storage area of the RAM 602, a buffer for the development of image data is prepared and has a lateral size corresponding to a pixel count Hp, in the main scanning direction, and a vertical size corresponding to a vertical pixel number of 64n (n is an integer equal to or greater than one), which is consonant with the nozzle arrays of the print head. Further, a print buffer in the RAM 602, to be referred to for the data to be transmitted to the print head, is prepared in the storage area of the RAM 602, and has a lateral size corresponding to a number of pixels Vp in the main scanning direction, and a vertical size corresponding to a number of pixels 64n in the vertical direction, which is to be printed during a single scan of the print head.

During the scanning performed by the print head 3, the ASIC 603 accesses the storage area (the print buffer) in the RAM 602 directly, to obtain drive data for the ejection heaters at the individual ejection openings of the print head, and transmits the drive data to the print head 3 (i.e., to the drivers for the print head 3).

The control provided for divided pulses in the inkjet printer described above will now be explained.

Figure 4:
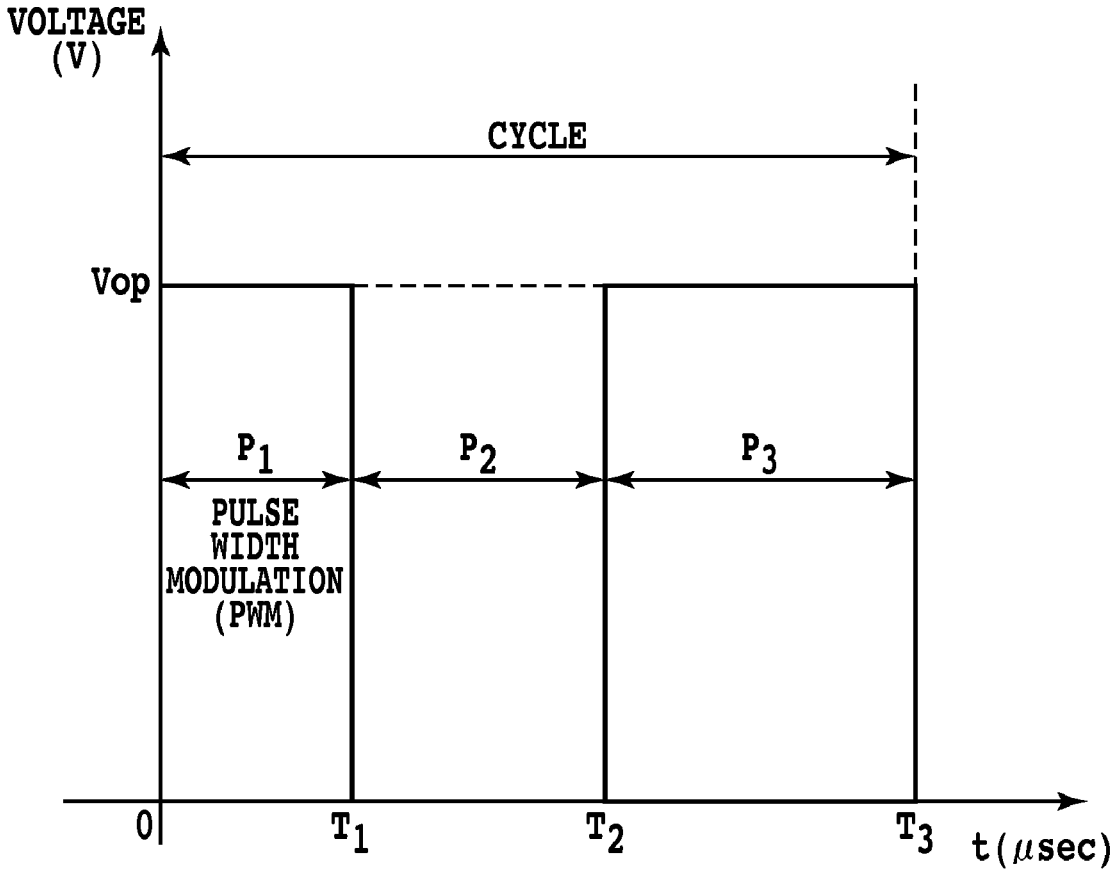
FIG. 4 is a diagram schematically showing divided heat pulses.

FIG. 4 is a diagram for explaining divided heat pulses and schematically showing the pulses. In FIG. 4, Vop denotes a drive voltage, P1 denotes a pulse width (represented by time; this is applied hereinafter) of a first pulse of the divided pulses (hereinafter referred to as a "pre-heat pulse"). P2 denotes an interval time (also called a "pause period"), and P3 denotes a pulse width of a second pulse of the divided pulses (hereinafter referred to as a "main heat pulse"). T1, T2 and T3 denote times used to determine the widths P1, P2 and P3 respectively. The drive voltage Vop is determined so that upon the application of the pulse of this voltage, an electro-thermal transducer element is provided with electric energy necessary to generate thermal energy for ink in the ink flow paths of the print head. The value assigned for the voltage is fixed, and is determined based on dimensions, a resistance and a film structure of the electro-thermal transducer element, and the flow path structure of the print head.

When divided pulses are employed to drive the print head 3, the pre-heat pulse of the width P1, the interval time of the width P2 and the main heat pulse of the width P3 are sequentially provided in this order. The pre-heat pulse is a pulse for controlling the temperature of ink in the flow path, and is used mainly to control the amount of ink ejected and the ink refill characteristic. The pre-heat pulse width is set to a value, such that when the pre-heat pulse is applied to the electro-thermal converting element, no ink is ejected but ink is heated by the thermal energy that is thus generated. The interval time is provided as a predetermined elapsed time period between the supply of the pre-heat pulse and of the main heat pulse, so that mutual interference, between the two pulses, is prevented and the temperature distribution for ink in the ink flow paths has become uniform. The main heat pulse is the pulse used for producing a bubble in ink in the ink flow path to eject ink through the ejection opening. The width of the main heat pulse is determined in accordance with dimensions and a resistance and a film structure of the electro-thermal transducer element, and the structure of the ink flow path.

Figure 5:
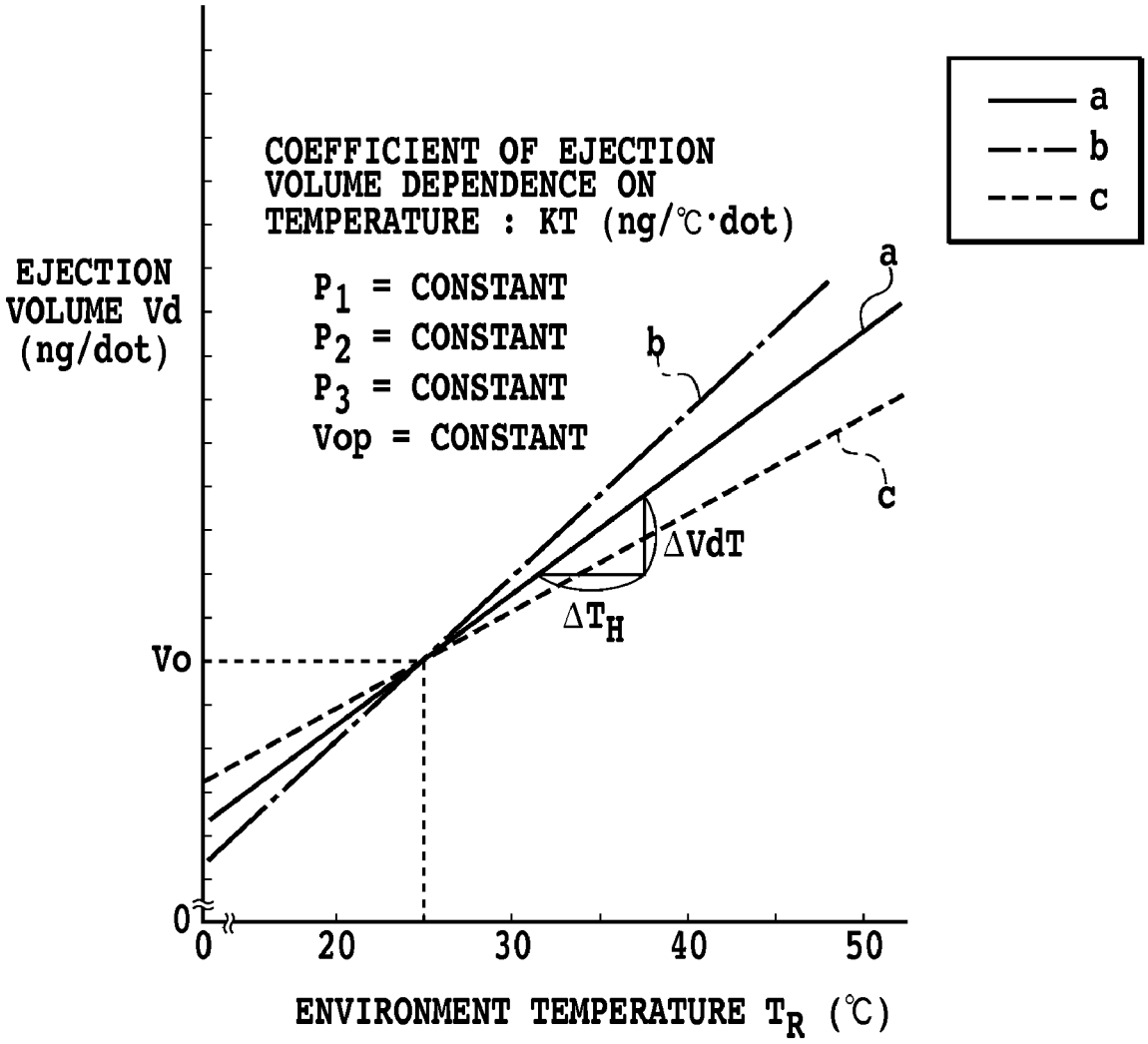
FIG. 5 is a diagram showing temperature dependency on the amount of ink ejected.

When the ejection control, which employs the above described divided heat pulses, is performed, basically, the amount of ink ejection and the refill characteristics of the print head can be determined. On the other hand, the amount of the ink ejection and the refill characteristics are also affected by the temperature of the print head (the ink temperature). FIG. 5 is a diagram showing the temperature dependency of the amount of the ink ejection. As indicated by a curve a in FIG. 5, an ejection volume Vd is linearly increased relative to an increase in environment temperature TR (=head temperature TH) of the print head. When the inclination of this line is defined as a temperature dependency coefficient KT, the temperature dependency coefficient KT is represented by

[Expression 1]

$$K_T = \frac{\Delta V_{dT}}{\Delta T_H}[ng/^\circ\ \text{C.}\cdot\text{dot}] \tag{1}$$

Regardless of the driving condition of the print head, the coefficient KT is determined in accordance with the structure of a print head and the property of ink. The print head represented by the curve "a" has the coefficient KT=0.3 [ng/° C.·dot]. Curves "b" and "c" in FIG. 5 represent the other print heads respectively.

The volume of the ink ejection and the refill characteristics can be controlled based on the above described relationship, as shown in FIG. 5, or by expression (1). This will now be described in detail.

Figure 6:
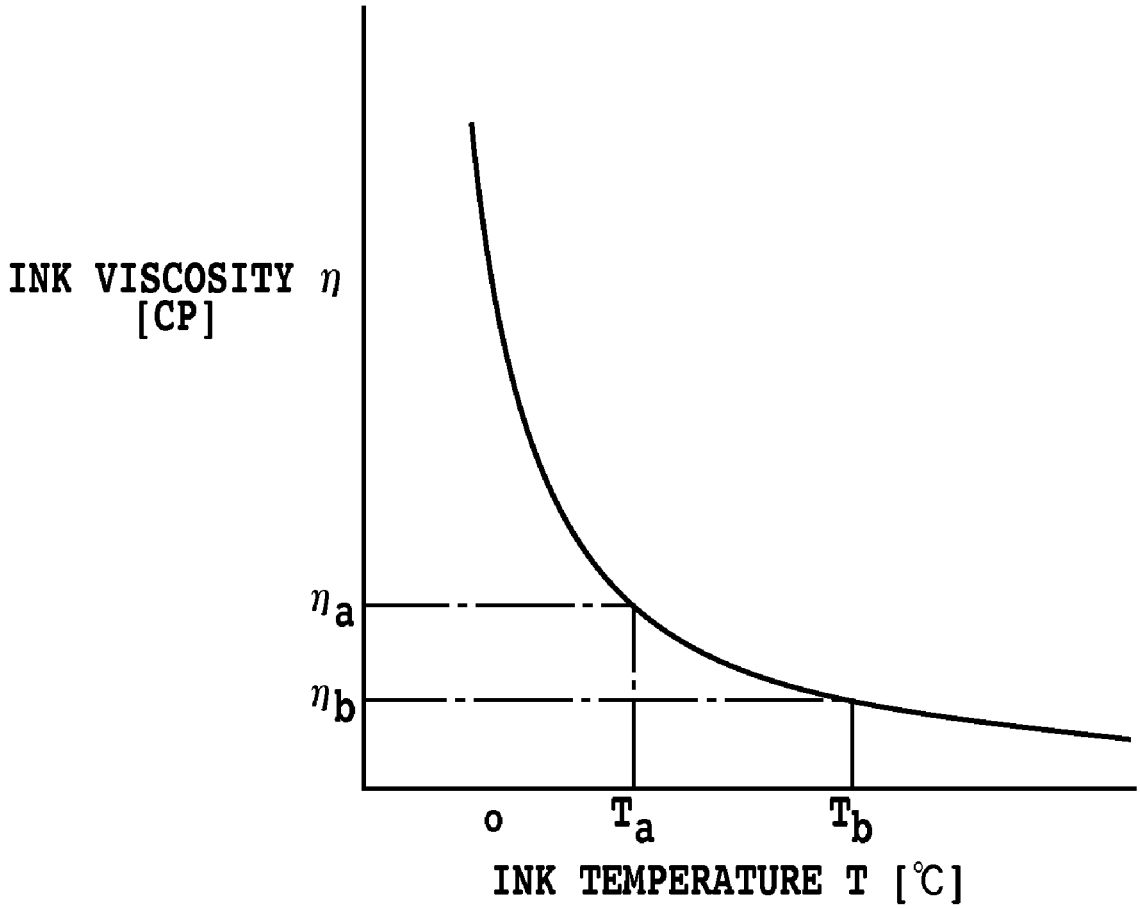
FIG. 6 is a diagram showing a relationship between the temperature and the viscosity of ink.

FIG. 6 is a diagram showing a relationship between an ink temperature T (° C.) and an ink viscosity η (T) (cp). While referring to FIG. 6, it is apparent that the viscosity of the ink is decreased as the temperature of the ink is increased. Therefore, when for the ink temperature a relationship Ta<Tb exists, an ink viscosity ηa>ηb is established.

Figure 7A:
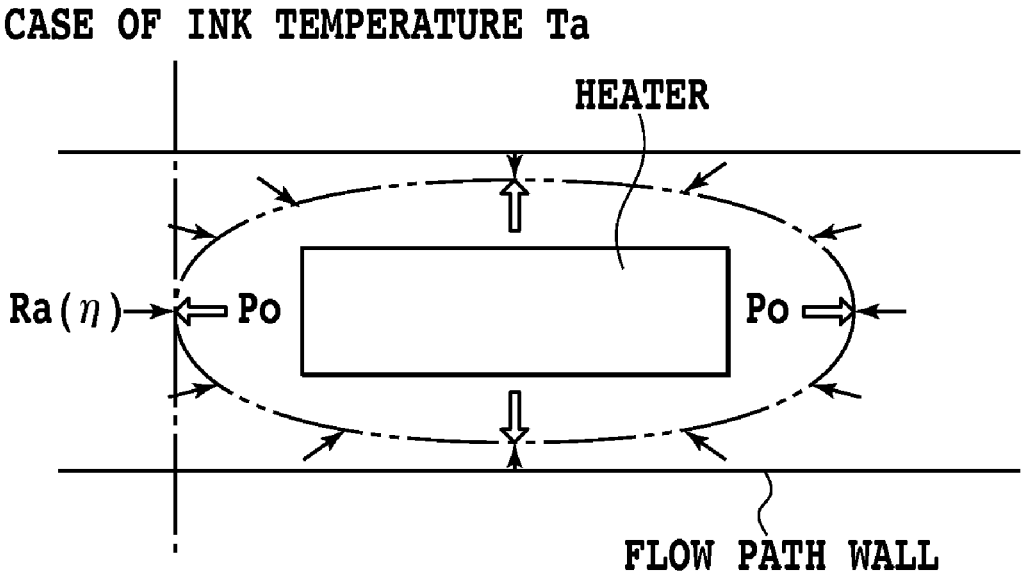
FIGS. 7A and 7B are diagrams showing bubble states when the specific energy required for bubble production is applied with a main heat pulse, and indicating a difference between the bubble production borders when the ink temperature differs.
Figure 7B:
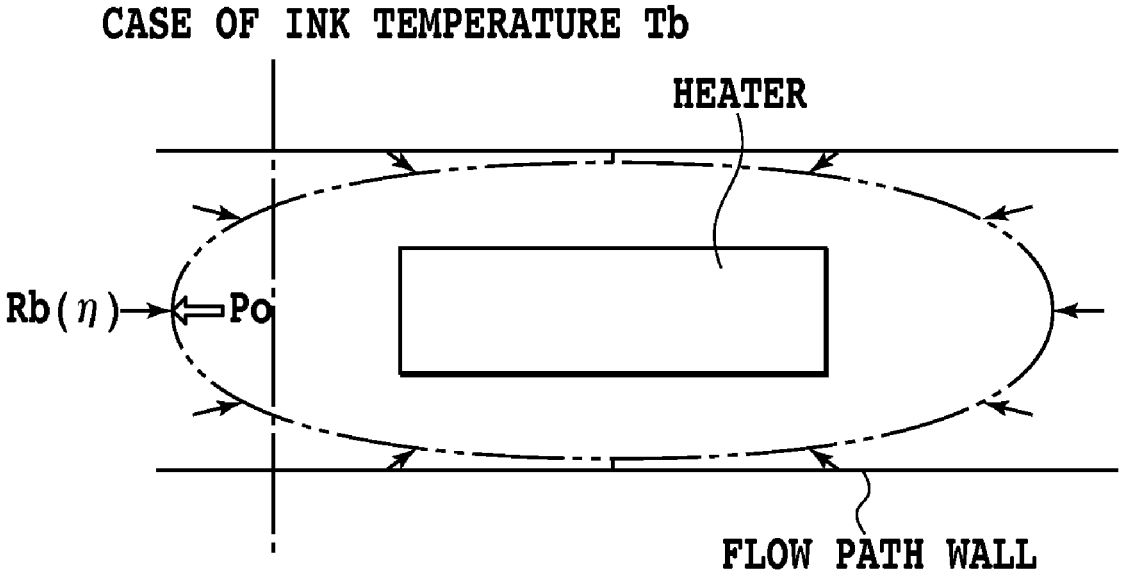

FIGS. 7A and 7B are diagrams illustrating bubble states in a case where the specific energy required to form a bubble is provided by applying the main heat pulse P3. Referring to FIGS. 7A and 7B, the boundary area of bubble growth is changed for different ink temperatures, i.e., different ink viscosities.

In FIG. 7A, a state is illustrated wherein the ink temperature Ta is relatively low, and the ink viscosity ηa is increased. Therefore, a viscous resistance Ra(η) of ink that suppresses bubble growth is high, relative to a pressure p0 which makes the bubble grow. Thus, the bubble growth area is limited to the range indicated by a dashed-dotted line. That is, the volume of the ink that will be ejected is corresponding to the bubble growth area. Further, since the viscosity resistance is increased in consonance with an increase in the ink viscosity, the speed at which ink is refilled by contraction of the bubble is reduced.

On the other hand, in FIG. 7B, the state is one wherein the ink temperature Tb is high, i.e., the relative ink viscosity ηb is lowered. In this case, the viscous resistance Rb(η) of ink that suppresses bubble growth is reduced, relative to the pressure p0 which makes a bubble grow. Thus, the bubble growth area can be extended to the range indicated by a dashed-two dotted line. That is, the volume of the ink to be ejected is corresponding to this comparatively large growth area. And furthermore, since the viscosity resistance has been reduced, the ink refill speed is increased, correspondingly to this lower ink viscosity.

As described above, in order to increase the amount of ink to be ejected and the refill speed, the temperature of ink should be increased not only near the ejection heater, but also in the area surrounding the ejection heater.

During this temperature adjustment operation, at time T1 (see FIG. 4; hereinafter, FIG. 4 also applies), immediately after energy of the pre-heat pulse P1 has been applied, the ink temperature near the ejection heater is high, but is lower a short distance from the ejection heater. Then, when about one microsecond has elapsed following the application of the pre-heat pulse P1, the temperature of the ink near the ejection heater is reduced, while the temperature at the short distance from the ejection heater is higher than at T1, and the temperature at a greater distance is somewhat increased.

At T2, several microseconds after the application of the pre-heat pulse P1, and immediately before the application of the main heat pulse P3, the ink temperature near the ejection heater has been further reduced. Whereas at the short distance from the ejection heater, the ink temperature has continued to increase, and at the greater distance, the temperature has been raised until equal that near the ejection heater.

As described above, following an application of pulse energy, a predetermined period of time (a time interval P2) is required to raise the temperature of ink that is relatively distant from an ejection heater. In this case, during a process by which a distributed ink temperature is changed, consequent with the elapse of time, through the transfer of thermal energy produced by the ejection heater, the total amount of energy available in an insulated system remains constant.

Further, for the energy provided by applying the pre-heat pulse P1 to be efficiently converted into ejection energy in the above described manner, it is important that the length of the interval time P2 should not be shorter than the width of the pre-heat pulse P1, even in the case that the width of the pre-heat pulse P1 has been extended to the maximum. When the pre-heat pulse P1 has been extended to the maximum, there will be an increase in the energy provided and the temperature of the ink near the ejection heater will become higher; but note, however, that, if the length of the interval time P2 is not appropriate, the temperature of the ink around the ejection heater will not be raised.

Since the above described temperature adjustment will reduce the viscosity of ink, the appropriate ink refill characteristics will be obtained, and high-duty printing will be enabled.

Figure 8:
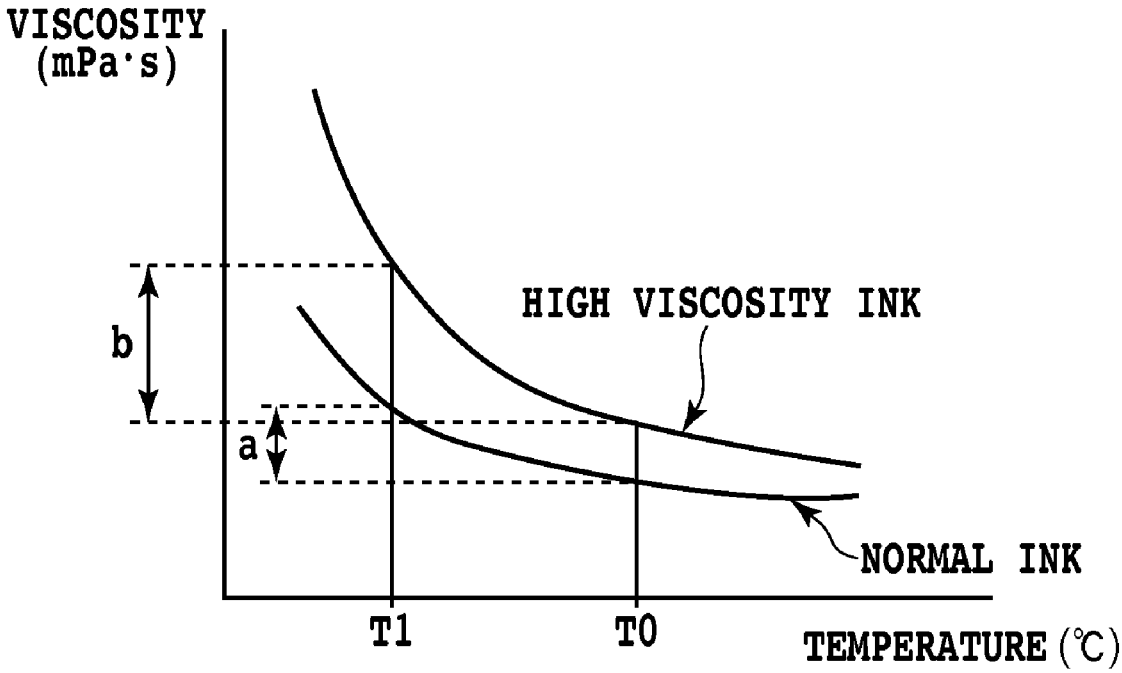
FIG. 8 is a diagram showing temperature-viscosity curves for ink having a high viscosity and normal ink having a lower viscosity.

FIG. 8 is a diagram showing the temperature-viscosity curves for ink having a comparatively high viscosity and for normal ink having a lower viscosity. As shown in FIG. 8, at a low temperature, the increase (denoted by a reference "b" in FIG. 8) in the viscosity of the ink of a high viscosity is greater than the increase (denoted by a reference "a" in FIG. 8) in the viscosity of the normal ink.

FIG. 9 is a diagram for explaining the refill characteristics obtained when a print head is driven under two temperature environments, while using the normal ink and the ink having a high viscosity of the embodiment, using a pre-heat pulse width that is determined by the conventional temperature adjustment process described in Japanese Patent Laid-Open No. 05-031905.

At a normal temperature (25° C.), the refill frequencies of the two inks were 15 kHz. On the other hand, at a low temperature (15° C.), the refill frequency of the normal ink is 12.8 KHz, and the refill frequency of the ink of the high viscosity is 11.7 KHz. In the case of these refill frequencies, when the printing duty is increased to be a duty higher than a predetermined level, for the ink of the high viscosity whose refill frequency is 11.7 KHz, the refilling of ink is not appropriately performed, and a printing failure occurred. More specifically, when the conventional temperature adjustment process employing the divided pulses is used, the viscosity of the high viscosity ink could not be decreased in a low temperature environment, so that the refill frequency is reduced. Specifically, as shown in FIG. 8, in the region at a low temperature where the increase (b) in the viscosity of the high viscosity ink is larger than the increase (a) in the viscosity of the normal ink, the conventional temperature adjustment operation can not reduce the viscosity of the high viscosity ink to a viscosity equivalent to that of the normal ink.

Therefore, in this embodiment, as shown in FIG. 10, when the environment temperature is equal to or lower than a predetermined, first temperature, a smaller width is set for the pre-heat pulse P1 than is set for a temperature that is higher than the first temperature. As a result, the volume of the ink ejection is reduced, and the refill characteristics are improved.

FIG. 11 is a diagram showing relations between ink viscosity and ejection states for respective pre-heat pulse widths in the low temperature environment. In the figure, a reference sign "o" represents a normal ejection and a reference sign "x" represents ejection failure. The high viscosity ink has higher viscosity than that of the normal ink.

First, a conventional temperature adjustment will be explained below. For the FIG. 11 diagram, a table No. 1 is used for the pre-heat pulse width for a low temperature environment. A table No. 2 is used for the pre-heat pulse width for a normal temperature environment. A table No. 3 is used for the pre-heat pulse width for a high temperature environment. As is evident from the contents of the tables No. 1 to No. 3, when the conventional temperature adjustment process is used, the pre-heat pulse width is extended as the detected environment temperature is reduced.

As is apparent from FIG. 11, as a result of the temperature adjustment using the pulse width of the table No. 1 at a low temperature, a printed image of lower density is obtained when printing of high duty is performed using the high viscosity ink. It is caused due to a refill failure. For the temperature adjustment shown in tables in No. 2 and No. 3, the refilling failure also occurs and lower density appears in the printed image.

In contrast, the temperature adjustment control according to the embodiment makes a volume of ejected ink relatively reduced. The pre-heat pulse width of a table No. 4 shown in FIG. 11, even in the low temperature environment, is shorter than that in table No. 1 for the conventional temperature adjustment. That is, the volume of ejected ink is made smaller than that of the conventional temperature adjustment and thus the refill frequency is made higher than the conventional refill frequency. This allows a refill failure not to occur, and a phenomenon such as the appearance of the low density is eliminated for high duty printing. That is, for the volume of ink to be ejected, Vd1>Vd2 is established, wherein Vd1 denotes the amount of ink to be ejected in a normal temperature environment, and Vd2 denotes the amount of ink to be ejected in a low temperature environment. When the amount of ink to be ejected is reduced in a low temperature, an adequate ink refill period can be obtained.

As described above, in a low temperature environment, the width of the pre-heat pulse is set to a value corresponding to the ink volume Vd2. Therefore, the pre-heat pulse width in the low temperature environment is smaller than the pre-heat pulse width in the normal temperature environment. It should be noted that the ink volume Vd2 is an ink ejection amount that speeds up the completion of the ink refill process. That is, in the image forming process at a low temperature, the "assuring the printing speed (refill speed)" is more important than "providing an ink volume equal to that provided at the normal temperature".

Figure 12:
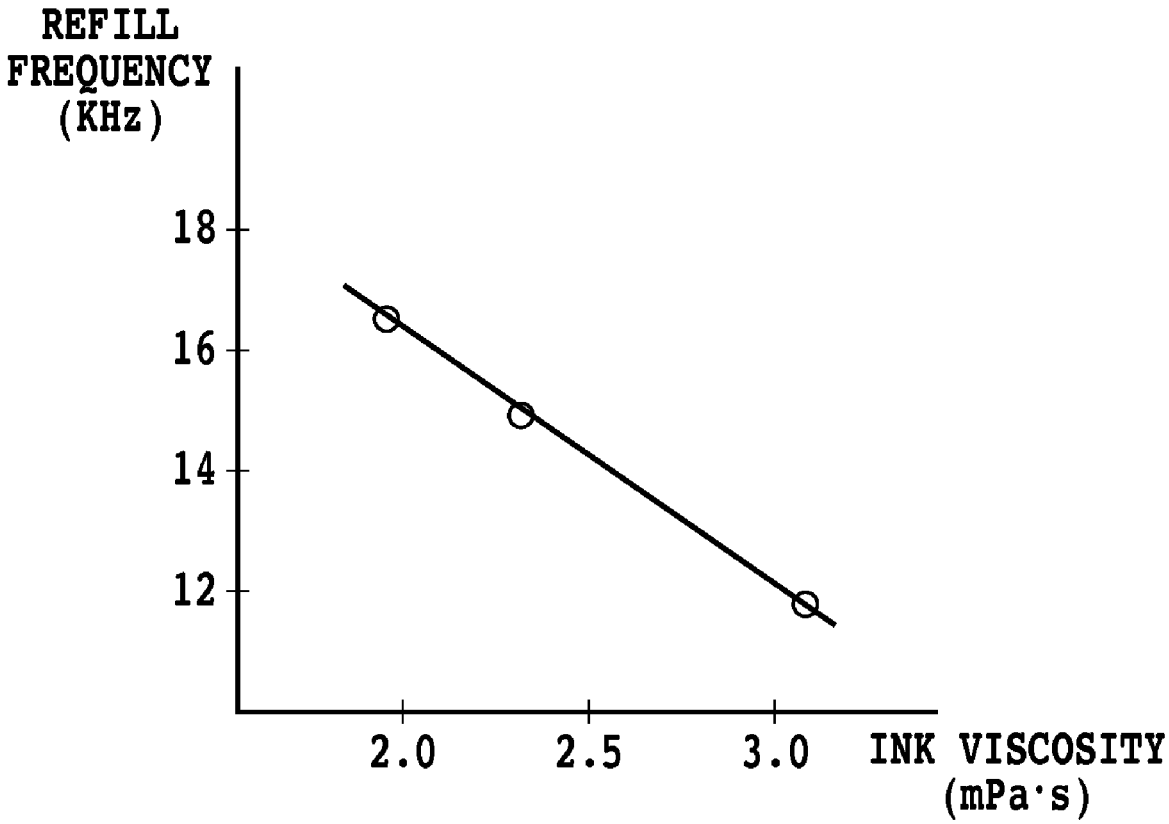
FIG. 12 is a diagram showing the relationship between the viscosity of ink and the refill frequency.

Specifically, referring to the ink temperature-viscosity curve shown in FIG. 8 and the ink viscosity-refill curve in FIG. 12, a refill failure occurs at a temperature of 19° C. or lower. Therefore, in this embodiment, table No. 4 is employed in a temperature environment of 19° C. or lower.

As shown in FIG. 13, at a temperature of 19° C. or lower, the pulse width indicated in table No. 4 is employed to drive the print head, and at a temperature higher than 19° C., the pulse width indicated in the table which is used for a normal temperature environment is employed to drive the print head.

In the above description, ink having the viscosity shown in FIG. 8 has been presented as an example, and the content of table No. 4 has been employed under the environment at the temperature of 19° C. or lower. When, however, ink having a different viscosity is employed, quite naturally, the viscosity for a temperature environment of 19° C. or lower is changed, and a different table is employed. For example, in a case wherein a refill frequency of 15 KHz for the ink at the normal temperature (25° C.) is changed to the refilling frequency 12.0 KHz at the low temperature (15° C.), high-duty printing can be appropriately performed, even when table No. 3 is employed for an environment temperature of 19° C. or lower.

Furthermore, the viscosity at a temperature of 19° C. or lower is increased as the temperature is decreased in a range from equal to or lower than 19° C. to equal to or higher than 15° C., to a range from less than 15° C. to equal to or higher than 10° C. to a range of less than 10° C. In such case, as shown in FIG. 14, when table No. 4 is employed for all the temperature ranges, the refill frequency is lowered in accordance with an increase in the viscosity (see FIGS. 8 and 12).

Thus, even when the temperature is 19° C. or lower, the refill frequency can be increased simply by changing the table in consonance with the temperature. For example, as shown in FIG. 15, table No. 4 is employed for the range of from equal to or lower than 19° C. to equal to or higher than 15° C., and table No. 5, for a smaller pre-heat pulse width, is employed for the range of from less than 15° C. to equal to or higher than 10° C. Furthermore, table No. 6, for a much smaller pulse width, is employed for the range for less than 10° C. Therefore, satisfactory printing results can be obtained.

When the ejection process or the temperature adjustment process described above is performed, the refill function can be improved without an accompanying deterioration in an optical density (OD) at a low temperature, and printing can be appropriately performed.

Further, in a printing operation performed based on a temperature adjustment performed using table No. 4, the procedure employed for adding a processing fluid to a printing medium may also be performed so that the optical density can be increased, as one of the inkjet printer processes.

Second Embodiment

A second embodiment of the preset invention relates to a case wherein a high viscosity ink, described in the first embodiment, is employed as black ink, and normal ink (a low viscosity ink) is employed as color ink (cyan, magenta and yellow inks).

Since the viscosity differs for black ink and for color ink, different tables are employed in a temperate environment of 19° C. or lower. For black ink, as in the first embodiment, table No. 2 is employed for a normal temperature environment, table No. 3 is employed for a high temperature environment, and table No. 4 is employed for a low temperature environment. For color ink, a pulse width is used that is obtained by employing the conventional temperature adjustment, and is reduced when the detected environment temperature is high. Specifically, as well as the tables employed for the conventional temperature adjustment, table No. 1 is employed for the low temperature environment, table No. 2 is employed for the normal temperature environment and table No. 3 is employed for the high temperature environment.

In such a case, wherein a plurality of types of inks having different viscosities are employed, the tables corresponding to these ink types must only be employed to perform appropriate printing.

Third Embodiment

According to a third embodiment of the present invention, an inkjet printer includes a plurality of printing modes, and selects one of the modes to perform printing. Contents that overlap those for the first embodiment will not be repeated.

As printing modes, an inkjet printer includes, for example, a speed preference mode and an image quality preference mode, and a controller 600 controls a printing operation in accordance with the selected printing mode.

In the speed preference mode, printing is performed using an ink volume Vd1 in a normal temperature environment, and using an ink volume Vd2 in a low temperature environment. On the other hand, in the image quality preference mode, printing is performed using the ink volume Vd1, in both a normal temperature environment and a low temperature environment. It should be noted, however, that a drive frequency for performing printing using the ink volume Vd1 should be considerably lower than the refill frequency. Through this processing, since an ink refill can be appropriately performed, deterioration of the image quality can be prevented, even for high duty printing.

Other Embodiment

In addition, a temperature sensor may be provided for a print head, and temperature information for the print head, obtained by the temperature sensor, may be employed to select a table.

In the above description of the embodiments, pigment ink has been employed as high viscosity ink; however, the ink employed for the present invention is, of course, not limited to this type of ink. So long as the refill characteristics of ink are lowered at a predetermined temperature or less, the present invention can be applied for any type of ink, and a predetermined temperature can be determined in accordance with the characteristics of the ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-024157, filed Feb. 4, 2008, which is hereby incorporated by reference herein in its entirety.

What is claimed is:

1. An ink jet printing apparatus that uses a print head, which applies an electric pulse to an electro-thermal transducer element to generate a bubble in ink and ejects ink by means of pressure of the bubble, to perform printing, said apparatus comprising:

a driving unit for applying the electric pulse, including a pre-heat pulse by which no ink is ejected, a main heat pulse for ejecting ink which is applied after the pre-heat pulse is applied, and a pause period between the pre-heat pulse and the main heat pulse, to the electro-thermal transducer element; and a pulse width control unit for, when temperature related to a viscosity of ink is equal to or lower than a predetermined temperature, causing a width of the pre-heat pulse to be smaller than a width of the pre-heat pulse used when the temperature related to a viscosity of ink is higher than the predetermined temperature.

2. An ink jet printing apparatus as claimed in claim 1, which uses high viscosity ink having a high viscosity as the ink and which also uses normal ink having a lower viscosity than that of the high viscosity ink as the ink, and wherein said pulse width control unit causes a width of the pre-heat pulse to be smaller when the high viscosity ink is used than a width of the pre-heat pulse when the normal ink is used.

3. An ink jet printing apparatus as claimed in claim 1, wherein said pulse width control unit causes the width of the pre-heat pulse when the temperature related to a viscosity of ink is equal to or lower than the predetermined temperature to be smaller than the width of the pre-heat pulse used when the temperature related to a viscosity of ink is higher than the predetermined temperature, so that a volume of ejected ink when the temperature is equal to or lower than the predetermined temperature is made smaller than that when the temperature is higher than the predetermined temperature.

4. An ink ejection control method in an ink jet printing apparatus that uses a print head, which applies an electric pulse to an electro-thermal transducer element to generate a bubble in ink and ejects ink by means of pressure of the bubble, to perform printing, said method comprising:

a driving step of applying the electric pulse, including a pre-heat pulse by which no ink is ejected, a main heat pulse for ejecting ink which is applied after the pre-heat pulse is applied, and a pause period between the pre-heat pulse and the main heat pulse, to the electro-thermal transducer element; and a pulse width control step of, when temperature related to a viscosity of ink is equal to or lower than a predetermined temperature, causing a width of the pre-heat pulse to be smaller than a width of the pre-heat pulse used when the temperature related to a viscosity of ink is higher than the predetermined temperature.

5. An ink ejection control method as claimed in claim 4, wherein the ink jet printing apparatus uses high viscosity ink having a high viscosity as the ink and which also uses normal ink having a lower viscosity than that of the high viscosity ink as the ink, and said pulse width control step causes a width of the pre-heat pulse to be smaller when the high viscosity ink is used than a width of the pre-heat pulse when the normal ink is used.

6. An ink ejection control method as claimed in claim 4, wherein said pulse width control step causes the width of the pre-heat pulse when the temperature related to a viscosity of ink is equal to or lower than the predetermined temperature to be smaller than the width of the pre-heat pulse used when the temperature related to a viscosity of ink is higher than the predetermined temperature, so that a volume of ejected ink when the temperature is equal to or lower than the predetermined temperature is made smaller than that when the temperature is higher than the predetermined temperature.

* * * * *